US008201525B2

(12) United States Patent
Shiobara et al.

(10) Patent No.: US 8,201,525 B2
(45) Date of Patent: Jun. 19, 2012

(54) COOLING DEVICE FOR ENGINE

(75) Inventors: Katsuyoshi Shiobara, Gunma-ken (JP); Hidehiko Koyashiki, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 269 days.

(21) Appl. No.: 12/379,587

(22) Filed: Feb. 25, 2009

(65) Prior Publication Data

US 2009/0255488 A1 Oct. 15, 2009

(30) Foreign Application Priority Data

Apr. 11, 2008 (JP) ..... 2008-104133

(51) Int. Cl.
*F01P 7/14* (2006.01)

(52) U.S. Cl. ..... 123/41.1; 123/41.01; 123/41.05; 123/41.08; 123/41.09; 123/41.12

(58) Field of Classification Search ..... 123/41.01, 123/41.1, 41.11, 41.08, 41.09, 41.05
See application file for complete search history.

(56) References Cited

U.S. PATENT DOCUMENTS

| | | | | |
|---|---|---|---|---|
| 4,381,736 | A * | 5/1983 | Hirayama | 123/41.1 |
| 4,475,485 | A * | 10/1984 | Sakakibara et al. | 123/41.05 |
| 4,534,506 | A * | 8/1985 | Ishida et al. | 236/35.3 |
| 4,564,506 | A * | 1/1986 | Saputo et al. | 422/266 |
| 5,711,258 | A | 1/1998 | Saur | |
| 5,839,397 | A * | 11/1998 | Funabashi et al. | 123/41.01 |
| 5,915,343 | A * | 6/1999 | Zenobi | 123/41.01 |
| 6,152,088 | A * | 11/2000 | Occella et al. | 123/41.1 |
| 6,371,060 | B1 | 4/2002 | Lehmann et al. | |
| 6,739,290 | B2 * | 5/2004 | Iwasaki et al. | 123/41.05 |
| 6,951,192 | B2 * | 10/2005 | Atschreiter et al. | 123/41.01 |
| 7,011,050 | B2 * | 3/2006 | Suda et al. | 123/41.1 |
| 7,243,620 | B2 * | 7/2007 | Takahashi | 123/41.1 |
| 2002/0050251 | A1 | 5/2002 | Takahashi et al. | |
| 2002/0083905 | A1 * | 7/2002 | Kim | 123/41.01 |

(Continued)

FOREIGN PATENT DOCUMENTS

DE 34 35 833 4/1986

(Continued)

OTHER PUBLICATIONS

European Search Report dated Jun. 29, 2009.

*Primary Examiner* — Noah Kamen
*Assistant Examiner* — Long T Tran
(74) *Attorney, Agent, or Firm* — McGinn Intellectual Property Law Group, PLLC

(57) ABSTRACT

A cooling device for an engine including a radiator circulation flow channel, a heater circulation flow channel, a bypass circulation flow channel, a valve, and a pump. The channels merge in the thermostat and form a common flow channel between the thermostat and the engine. The pump is provided in the common flow channel. At a start of a warm-up period and during the warm-up operation, circulation is substantially stopped by the thermostat, cooling water circulation is actuated in the bypass circulation flow channel, and an opening degree of the electronically controlled valve is gradually increased from a minimum as the cooling water temperature rises. The electronically controlled valve is not completely closed even when closed, and is open to a certain degree from an initial stage of the warm-up period, thereby causing part of the cooling water to flow in the bypass circulation flow channel.

8 Claims, 6 Drawing Sheets

U.S. PATENT DOCUMENTS

| | | | | |
|---|---|---|---|---|
| 2003/0024490 | A1* | 2/2003 | Wand et al. | 123/41.01 |
| 2004/0098174 | A1* | 5/2004 | Suda et al. | 700/299 |
| 2005/0166870 | A1* | 8/2005 | Wenderoth et al. | 123/41.01 |
| 2006/0054111 | A1* | 3/2006 | Hansson et al. | 123/41.01 |
| 2007/0157893 | A1* | 7/2007 | Wei et al. | 123/41.08 |
| 2007/0175414 | A1* | 8/2007 | Miyahara et al. | 123/41.1 |

FOREIGN PATENT DOCUMENTS

| | | |
|---|---|---|
| DE | 40 33 261 | 4/1992 |
| DE | 196 06 202 | 8/1997 |
| DE | 199 32 313 | 1/2001 |
| EP | 0 038 556 | 10/1981 |
| JP | 2007-120381 | 5/2007 |

* cited by examiner

TW1=TW1a-TW1b

TW1a>TW1b

OPENING DEGREE ΔTW1 IS SMALL

TW1=TW1a-TW1b

TW1a=TW1b

TW1=0

OPENING DEGREE ΔTW1 AT MAXIMUM

COOLING DEVICE FOR ENGINE

BACKGROUND OF THE INVENTION

1. Field of the Invention

The present invention relates to a cooling device for an engine that can efficiently raise the temperature of cooling water within a short period of time during the warm-up operation of an automobile and makes it possible to simplify the structure of the cooling device.

2. Description of the Related Art

The demand for increased fuel efficiency and improved purification of exhaust gases in automobiles has been rapidly growing in recent years. Accordingly, means for rapidly raising the temperature of cooling water within the warm-up period immediately after the engine has been started and attaining the best possible state of the cooling water within a short period of time after the engine has been started have been actively researched, developed, and put to practical use with the object of increasing fuel efficiency and improving purification of exhaust gases in vehicles. Japanese Patent Application Laid-open No. 2007-120381 is a document aimed at such a rapid increase in cooling water temperature.

Japanese Patent Application Laid-open No. 2007-120381 discloses a configuration in which a radiator circulation flow channel having a radiator disposed therein, a heater circulation flow channel having a heater core disposed therein, and a bypass circulation flow channel where no heat exchange is performed are provided in parallel, a control valve is provided in the bypass circulation flow channel, and the control valve and a thermostat are disposed in series. The control valve is a pressure control valve and this valve opens when a pressure inside the bypass circulation flow channel becomes equal to or higher than a predetermined value. Within the warm-up period in which the cooling water temperature is low, the radiator circulation flow channel is shut down by the thermostat, the cooling water does not flow through the radiator, and the cooling water is prevented from cooling. Furthermore, within the warm-up period in which the cooling water temperature is low, the cooling water flows only through the heater circulation flow channel where the heater core is disposed, or the cooling water flows into the heater circulation flow channel and bypass circulation flow channel and the cooling water temperature is rapidly raised.

With Japanese Patent Application Laid-open No. 2007-120381, rapid increase in cooling water temperature can be attained. However, the following problems remain unresolved in the configuration of Japanese Patent Application Laid-open No. 2007-120381. First, when the water temperature is low before the control valve is opened (when the control valve is closed), both the thermostat and the control valve are almost closed. Therefore, almost the entire cooling water flows in the heater circulation flow channel where the heater core is disposed. Because the heater core is a heat dissipation source, heating of the cooling water is delayed due to heat dissipation from the heater core.

Furthermore, when the water temperature is low and when the pump operates at a high revolution speed such that the control valve is not open (a state in which the predetermined pressure is not reached), the cooling water does not flow in the bypass circulation flow channel and flows into the heater circulation flow channel where the heater core is disposed. As a result, a larger amount of cooling water flows into the heater core. For this reason, a large amount of heat of the cooling water is taken away by the heater core and, therefore, the cooling water temperature rises even more slowly. In addition, at a pressure or water temperature at which the thermostat is closed and the control valve is opened, the cooling water does not flow into the radiator, and because the control valve is opened, the cooling water flows into the heater circulation flow channel and bypass circulation flow channel.

However, the bypass circulation flow channel has a structure different from that of the heater circulation flow channel and no specific objects offering resistance to the passing water are present in the bypass circulation flow channel. For this reason, a major portion of cooling water flows into the bypass circulation flow channel and because no resistance is offered to the flow, the flow speed of the cooling water flowing in the bypass circulation flow channel become extremely high. An extremely high flow speed of cooling water means that the interval in which the cooling water stays in the engine, which is a heat generation source, is short, the amount of heat picked up by the cooling water is small, and temperature increase in cooling water is delayed. As described hereinabove, where the control valve is opened, most of cooling water flows in the bypass circulation flow channel that offers little resistance to the passing water, and the amount of cooling water flowing in the heater circulation flow channel decreases. Therefore, the capacity to warm up the heater core decreases. As a result, the warming temperature decreases.

Furthermore, because of very rapid opening and closing of the control valve, the flow rate (flow speed) of cooling water flowing in the bypass circulation flow channel rapidly changes and there is also a risk of pulsations or a water hammer phenomenon occurring inside a piping. Because pipes of a cooling water circuit for a vehicle are connected in a continuous manner along the entire perimeter, a shock wave generated in the piping propagates through the entire cooling water circuit. As a result, because the heater core is disposed in the cooling water circuit in a location closest to the driver to warm the inside of the vehicle, the shock wave can cause vibrations of the heater core and discomfort (noise or vibrations) to the driver.

SUMMARY OF THE INVENTION

In addition, because the control valve is controlled by pressure and has a structure that is not open till a certain predetermined pressure is reached, the pressure inside the piping of the cooling water circuit continuous rising till the control valve opens, and the increase in pressure inside the piping can shorten the service life of the piping of the cooling water circuit. It is an object of the present invention to enable an efficient increase in temperature of cooling water within a short period of time during the warm-up operation of an automobile and simplify the cooling device structure.

Accordingly, the inventors have conducted a comprehensive study aimed at the resolution of the above-described problems. The results obtained demonstrated that the aforementioned problems can be resolved by first aspect of the invention that relates to a cooling device for an engine, comprising a radiator circulation flow channel for circulation from an engine via a radiator and a thermostat; a heater circulation flow channel for circulation from the engine via a heater core and the thermostat; a bypass circulation flow channel for circulation from the engine via the thermostat; an electronically controlled valve; and a pump that circulates a cooling water, wherein the radiator circulation flow channel, the heater circulation flow channel, and the bypass circulation flow channel merge in the thermostat and form a common flow channel between the thermostat and the engine, the pump is provided in the common flow channel, at the start of the warm-up period and during the warm-up operation, circulation in the radiator circulation flow channel is substantially stopped by the thermostat, cooling water circulation is actuated in the bypass circulation flow channel, and an opening degree of the electronically controlled valve is gradually increased from a minimum as the cooling water temperature rises, and at the end of the warm-up period, circulation is actuated in the radiator circulation flow channel and substantially stopped in the bypass circulation flow channel.

In accordance with second aspect of the invention, the above-described problems are resolved by a cooling device for an engine of the above-described configuration, wherein a water temperature measurement and control unit comprising a sensor and an ECU is provided in a location downstream of the engine in the radiator circulation flow channel, and a valve opening degree of the electronically controlled valve increases gradually from a substantially closed state as a difference between a measured water temperature determined by the water temperature measurement and control unit and a set water temperature at the end of the warm-up period decreases. In accordance with third aspect of the invention, the above-described problems are resolved by a cooling device for an engine of the above-described configuration, wherein a detection unit that detects a revolution speed of the engine and an engine load is provided, and a valve opening degree of the electronically controlled valve gradually decreases as the engine revolution speed and load increase. In accordance with forth aspect of the invention, the above-described problems are resolved by a cooling device for an engine of the above-described configuration, wherein a heater valve is provided upstream of the heater core of the heater circulation flow channel, and circulation in the heater circulation flow channel can be appropriately stopped.

In first aspect of the invention, an electronically controlled valve is provided in which the opening degree of the opening-closing valve is gradually increased from a minimum thereof as the cooling water temperature rises in the bypass circulation flow channel. Furthermore, at the start of the warm-up period and during the warm-up operation, the thermostat substantially stops the circulation of cooling water in the radiator circulation flow channel, and almost the entire cooling water flows through the bypass circulation flow channel. In such a state and also in a state with a low temperature of cooling water, the opening degree of the opening-closing valve of the electronically controlled valve becomes small. Therefore, the flow rate of cooling water in the location of the electronically controlled valve becomes small and the flow speed of cooling water flowing through the entire bypass circulation flow channel decreases.

As a result, an interval in which the cooling water passes inside the engine is increased and the cooling water temperature can rise rapidly. Furthermore, at the end of the warm-up period, circulation is actuated in the radiator circulation flow channel and stopped in the bypass circulation flow channel, whereby a smooth transition can be made to the normal operation of cooling water and a smooth transition can be made from the cooling water circulation in the bypass circulation flow channel to the cooling water circulation in the radiator circulation flow channel.

In particular, when warming is stopped (OFF), the heater circulation flow channel is shut down. Therefore, practically the entire cooling water flows in the bypass circulation flow channel having no specific heat dissipation source and the cooling water temperature can be further increased. Furthermore, because the opening and closing valve is opened and closed gradually in the electronically controlled valve and the flow of cooling water in the bypass circulation flow channel can be changed gradually, abrupt changes in the flow of cooling water inside the bypass circulation flow channel are prevented. Therefore, shock waves can hardly occur and noise or vibrations caused by such shock waves can be reduced. As a result, no discomfort is caused to the driver. In addition, the service life of piping constituting the circulation flow channels can be extended.

In second aspect of the invention, a water temperature measurement and control unit comprising a sensor and an ECU is provided in a location downstream of the engine in the radiator circulation flow channel, and a valve opening degree of the electronically controlled valve increases gradually from a substantially closed state with a decrease in a difference between a measured water temperature determined by the sensor of the water temperature measurement and control unit and a set water temperature at the end of the warm-up period. As a result, the ECU can accurately determine the end time of the warm-up period from the temperature of cooling water, the opportunity for maximizing the opening degree of the opening-closing valve and making a transition from the cooling water circulation in the bypass circulation flow channel to the cooling water circulation in the radiator circulation flow channel can be adequately judged and realized, and very accurate transition can be made from the warm-up operation to normal operation.

In third aspect of the invention, a detection unit that detects a revolution speed of the engine and an engine load is provided, and a valve opening degree of the electronically controlled valve gradually decreases with an increase in the engine revolution speed and load, thereby making it possible to control the flow of cooling water with the electronically controlled valve correspondingly to the temperature variations of the cooling water and also the state of the engine. In forth aspect of the invention, a heater valve is provided upstream of the heater core of the heater circulation flow channel, and circulation in the heater circulation flow channel can be appropriately stopped. Therefore, the heater circulation flow channel can be shut down at the start of the warm-up period and during the warm-up operation, a structure is thus obtained in which cooling water flows only in the bypass circulation flow channel, and the cooling water temperature can be rapidly raised.

DESCRIPTION OF THE PREFERRED EMBODIMENTS

Figure 1:
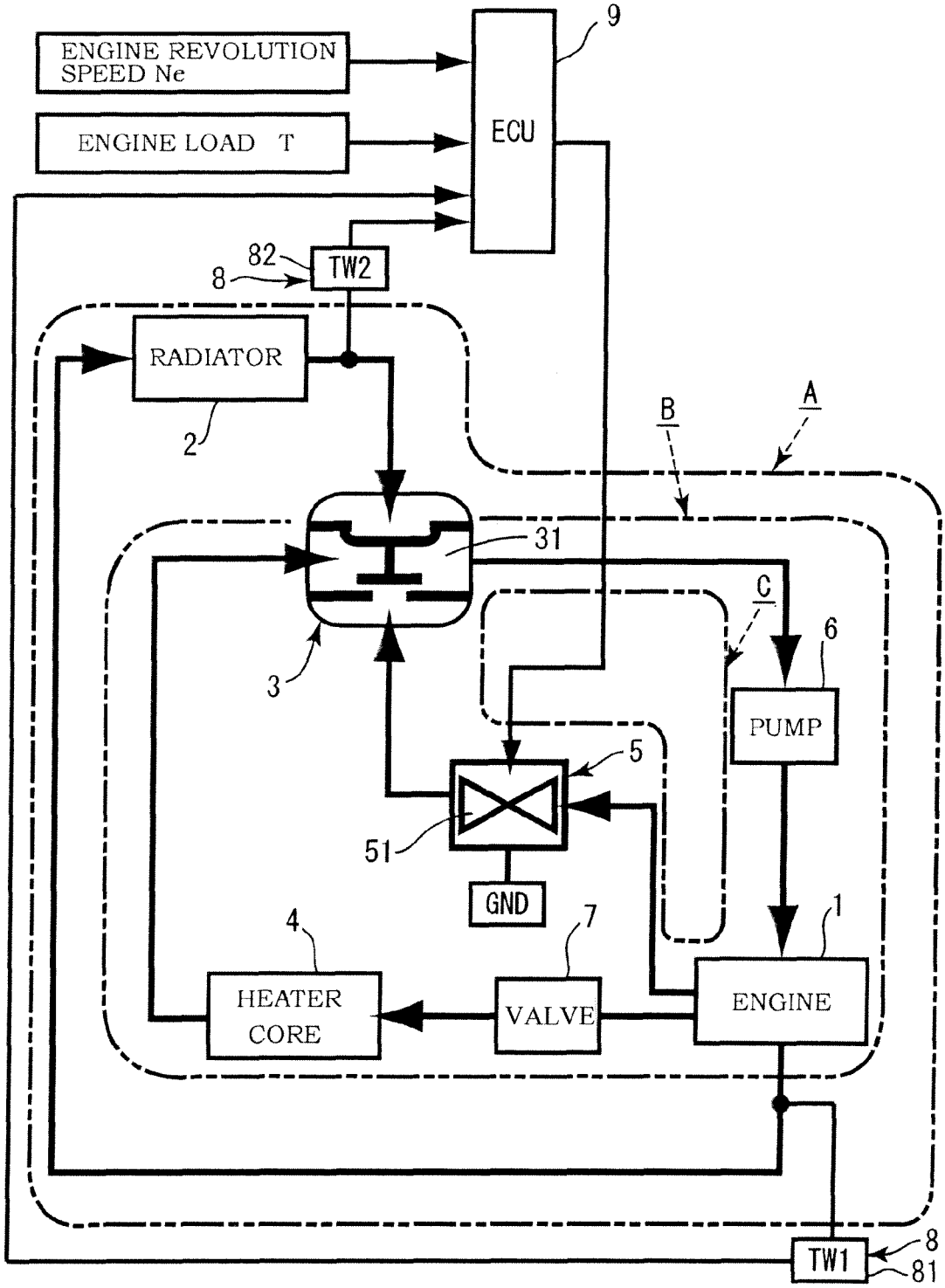
FIG. 1 is a structural diagram of a circulation flow channel illustrating the configuration of the present invention.

In accordance with the present invention, as shown in FIG. 1, a bypass circulation flow channel C is added to a radiator circulation flow channel A and a heater circulation flow channel B. These circulation flow channels are configured by a piping. The radiator circulation flow channel A is a circulation flow channel that returns from an engine 1 to the engine 1 via a radiator 2. The heater circulation flow channel B is a circulation flow channel that returns from the engine 1 to the engine 1 via a heater core 4. The bypass circulation flow channel C is a circulation flow channel that returns from the engine 1 to the engine 1 via an electronically controlled valve 5.

These circulation flow channels merge in a thermostat 3, and in the radiator circulation flow channel A, a flow channel passing from the engine 1 to the thermostat 3 via the radiator 2 serves as a radiator flow channel Ja. Furthermore, in the heater circulation flow channel B, a flow channel passing from the engine 1 to the thermostat 3 via the heater core 4 serves as a heater flow channel Jb. In the bypass circulation flow channel C, a flow channel passing from the engine 1 to the thermostat 3 via the electronically controlled valve 5 serves as a bypass flow channel Jc.

Furthermore, the radiator circulation flow channel A, heater circulation flow channel B, and bypass circulation flow channel C share one flow channel among the flow channels from the position of the thermostat 3 in which the circulation flow channels merge to the engine 1, and this shared flow channel serves as a common flow channel Jd. Thus, the radiator circulation flow channel A is configured by the radiator flow channel Ja and the common flow channel Jd, the heater circulation flow channel B is configured by the heater flow channel Jb and the common flow channel Jd, and the bypass circulation flow channel C is configured by the bypass flow channel Jc and the common flow channel Jd.

Figure 2:
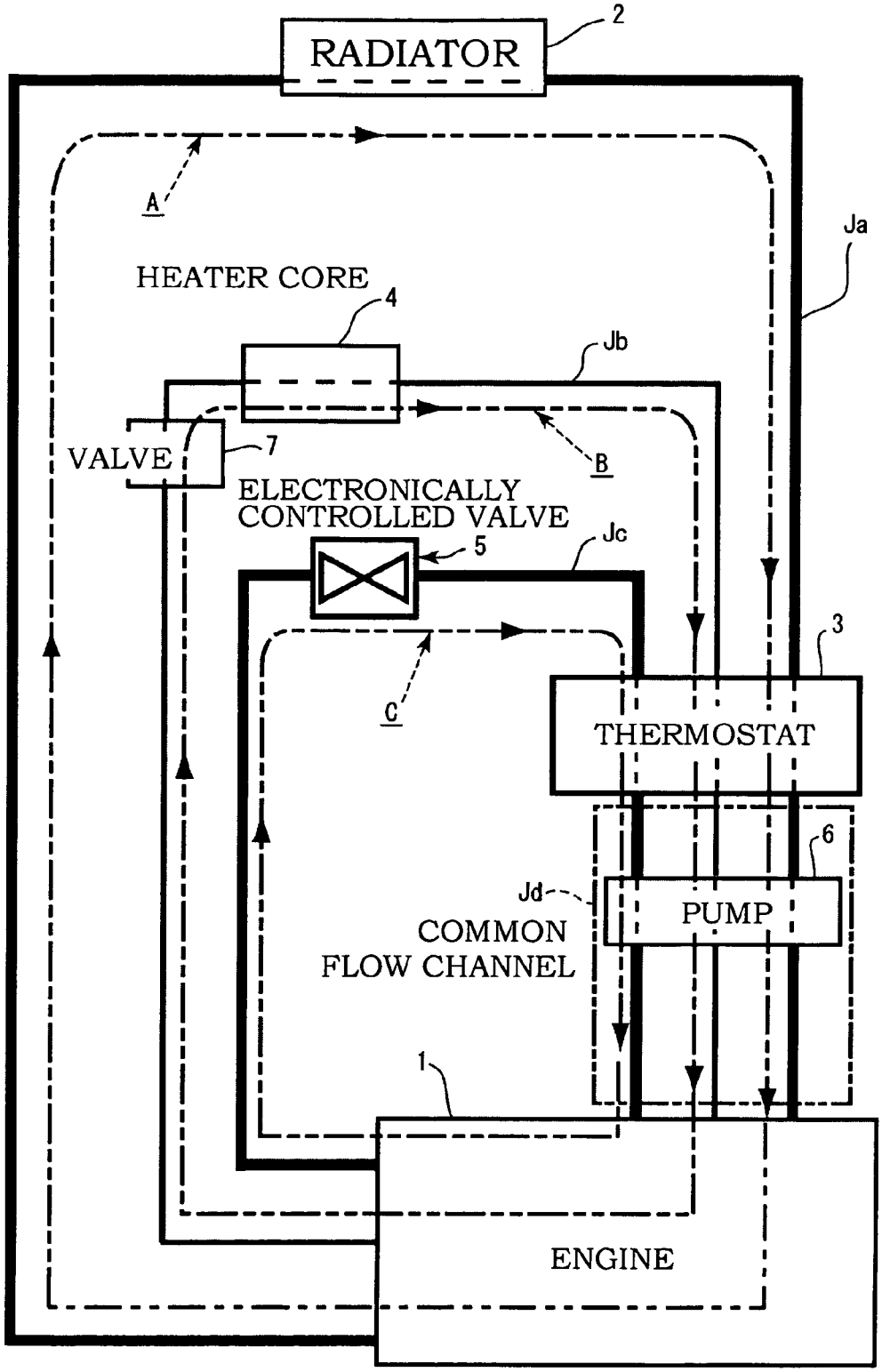
FIG. 2 is a structural diagram of a circulation circuit in which a radiator circulation flow channel, a heater circulation flow channel, and a bypass circulation flow channel are configured independently from each other.

Thus, the radiator flow channel Ja, heater flow channel Jb, and bypass flow channel Jc are mutually independent flow channels before they reach the thermostat 3 and become one common flow channel from the thermostat 3 to the engine 1. FIG. 2 is a diagram describing a state in which the radiator circulation flow channel A, heater circulation flow channel B, and bypass circulation flow channel C are mutually independent flow channels. The thermostat 3 comprises a directional control valve 31, and cooling water from the radiator flow channel Ja, heater flow channel Jb, and bypass flow channel Jc is appropriately distributed to the common flow channel Jd via the directional control valve 31 and the cooling water returns to the engine 1.

The electronically controlled valve 5 is provided with an opening and closing valve 51 controlled by the below-described ECU 9 (Engine Control Unit). The opening and closing valve 51 operates so that the opening and closing valve 51 is opened based on an information signal from the ECU 9, and the cooling water then flows to the bypass flow channel Jc. The opening degree of the opening and closing valve 51 can be controlled with high accuracy. Thus, the electronically controlled valve 5 can be regulated within a range from a very small flow rate of cooling water to a very large flow rate in a fully open state. Furthermore, the opening operation of the opening and closing valve 51 is gradually performed following changes in the cooling water temperature, and no opening-closing operation is performed in a warm state.

A measurement and control unit that measures the cooling water temperature and controls the opening and closing of the opening and closing valve 51 of the electronically controlled valve 5 in the bypass circulation flow channel C is provided in the radiator circulation flow channel A. In the measurement and control unit, the measurements of cooling water temperature are actually performed by a water temperature sensor 8 provided in a location downstream of the engine 1. The zone downstream the engine 1 as referred to herein is a flow channel on the side where the cooling water flows out of the engine 1, and the zone upstream of the engine 1 is a flow channel where the cooling water flows into the engine 1. Therefore, the water temperature sensor 8 is provided in a position of the radiator flow channel Ja of the radiator circulation flow channel A close to the engine 1. A water temperature sensor 8 is also provided downstream of the radiator 2 in the radiator circulation flow channel A.

The water temperature sensor 8 located downstream of the engine 1 in the radiator circulation flow channel A will be referred to as a first water temperature sensor 81. Furthermore, a water temperature sensor 8 is also provided downstream of the radiator 2. This water temperature sensor 8 located downstream of the radiator 2 will be referred to as a second water temperature sensor 82. The second water temperature sensor 82 is provided between the radiator 2 and the thermostat 3 in the radiator flow channel Ja (see FIG. 1). The second water temperature sensor 82 corrects the measurements of water temperature performed by the first water temperature sensor 81 on the basis of various conditions so that the cooling water flows into the circulation flow channels under even more advantageous conditions. The water temperature sensors 8 (first water temperature sensor 81 and second water temperature sensor 82) measure the temperature of cooling water and transmit this information to the ECU 9. The ECU 9 determines the state and transmits information that determines the opening degree of the opening and closing valve 51 to the electronically controlled valve 5.

A rapid heating operation of cooling water at the start of the warm-up period and during the warm-up operation in the configuration in accordance with the present invention will be described below. Initially, when the heating is stopped (OFF), a heater valve 7 is closed, the flow of cooling water in the heater circulation flow channel B is substantially interrupted, and a state is assumed in which the cooling water practically does not pass through the heater core 4 (see FIG. 3). The heater valve 7 is operated by a heating switch located in a driver's cabin. At the same time, the flow of cooling water in the radiator circulation flow channel A is substantially interrupted by the directional control valve 31 of the thermostat 3, and a state is assumed in which the cooling water practically does not pass into the radiator 2 (see FIG. 3). In this state, the cooling water passes only through the bypass circulation flow channel C, the flow speed of the cooling water is inhibitory controlled by the electronically controlled valve 5 to a slow state, and because the cooling water moves inside the engine 1 at a low speed, the cooling water temperature rises rapidly.

The opening and closing valve 51 of the electronically controlled valve 5 is opened and closed by the water temperature measurement and control unit in the following manner. Here, the simplest basic configuration will be explained in which the water temperature sensor 8 of the water temperature measurement and control unit includes only the first water temperature sensor 81. Initially, an opening degree $\Delta TW1$ of the opening and closing valve 51 of the electronically controlled valve 5 is set by the first water temperature sensor 81 and the ECU 9. The opening degree ΔTW1 is an aperture of the opening and closing valve 51, and the amount of cooling water flowing through the electronically controlled valve 5 is determined by the value of the opening degree ΔTW1. As a result, the flow speed of the cooling water in the entire bypass circulation flow channel C is determined.

Figure 3A:
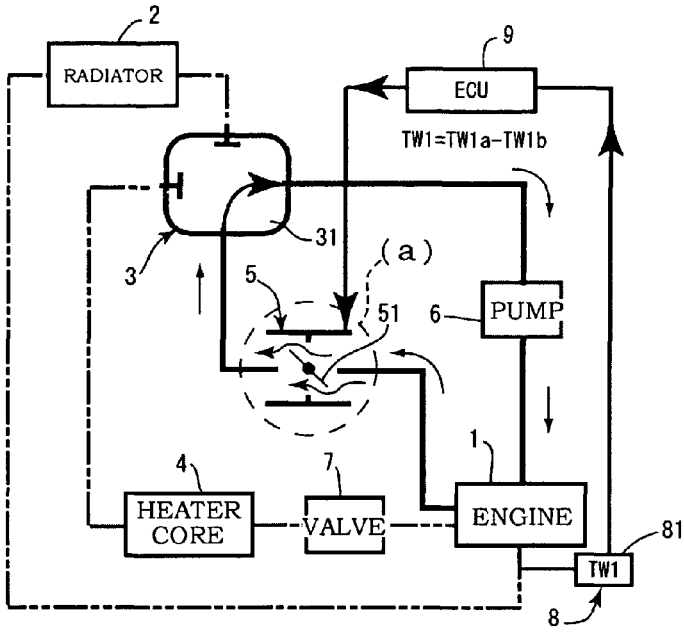
FIG. 3A is a structural diagram illustrating a flow of cooling water in the bypass circulation flow channel at the start of the warm-up period.
Figure 3B:
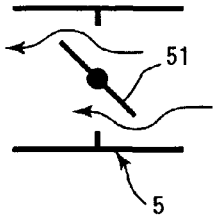
FIG. 3B is an enlarged view of portion (a) in FIG. 3A.

When the opening degree ΔTW1 is large, the opening of the opening and closing valve 51 is large (see FIGS. 3C and 3D), and when the opening degree ΔTW1 is small, the opening of the opening and closing valve 51 is small (see FIGS. 3A and 3B). The opening degree ΔTW1 is controlled by sending to the ECU 9 an information signal representing the temperature difference between a set water temperature TW1*a* at the end of the warm-up period in the portion downstream of the engine and a measured water temperature TW1*b* downstream of the engine. The temperature difference TW1 is determined by the following equation:

Temperature difference *TW*1=Warm-up end set water temperature *TW*1*a*−Measured water temperature *TW*1*b*.

Here, the measured water temperature TW1*b* is a water temperature that is actually measured by the water temperature sensor 8.

The opening degree ΔTW1 of the opening and closing valve 51 of the electronically controlled valve 5 is determined by the temperature difference TW1. Thus, the opening degree can be represented by the following equation:

Δ*TW*1=(Warm-up end water temperature in the portion downstream of the engine)−(Water temperature in the portion downstream of the engine) (*TW*1*b*).

The temperature difference TW1 is set such that the opening degree ΔTW1 increases as the temperature difference decreases. As a result, when the temperature difference TW1 is large, that is, when the measured water temperature TW1*b* is sufficiently lower than the set water temperature TW1*a*, the opening and closing valve 51 of the electronically controlled valve 5 is so controlled that the opening degree ΔTW1 decreases (see FIGS. 3A and 3B) and the flow rate of the cooling water flowing through the electronically controlled valve 5 in the bypass circulation flow channel C decreases. Therefore, a state is assumed in which the flow speed of the cooling water in the entire bypass circulation flow channel C decreases, the cooling water passes inside the engine 1 over a longer period, and the cooling water temperature can be easily raised.

Figure 3C:
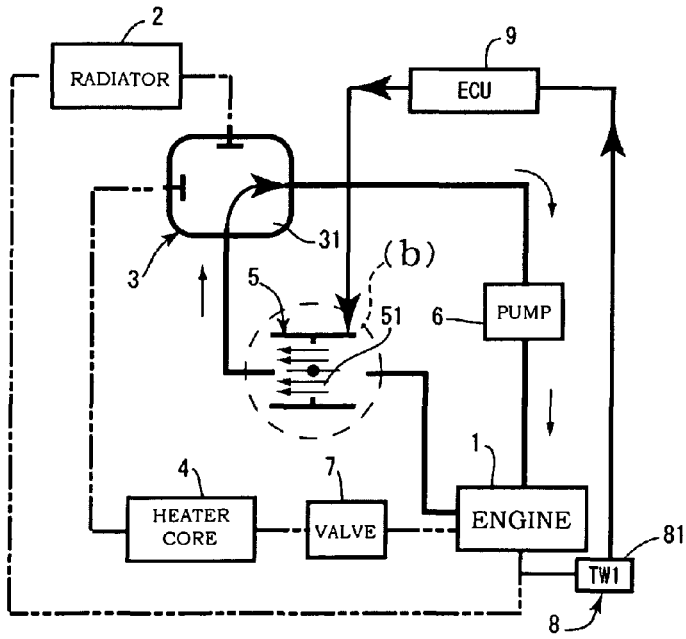
FIG. 3C is a structural diagram illustrating a flow of cooling water in the bypass circulation flow channel at the end of the warm-up period.
Figure 3D:
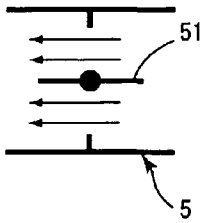
FIG. 3D is an enlarged view of portion (b) in FIG. 3C.
Figure 4A:
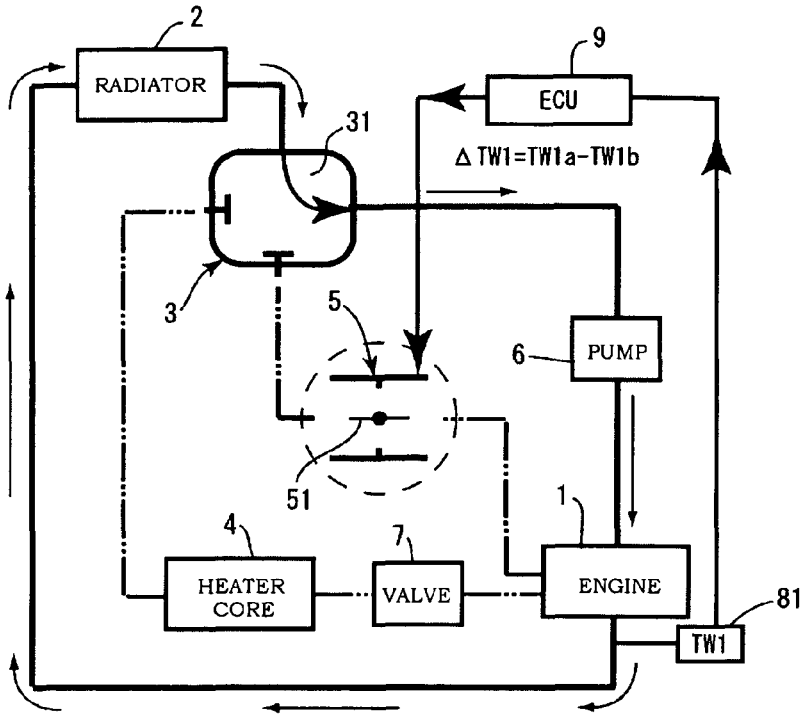
FIG. 4A is a structural diagram illustrating a flow of cooling water in the radiator circulation flow channel after the end of the warm-up period.
Figure 4B:
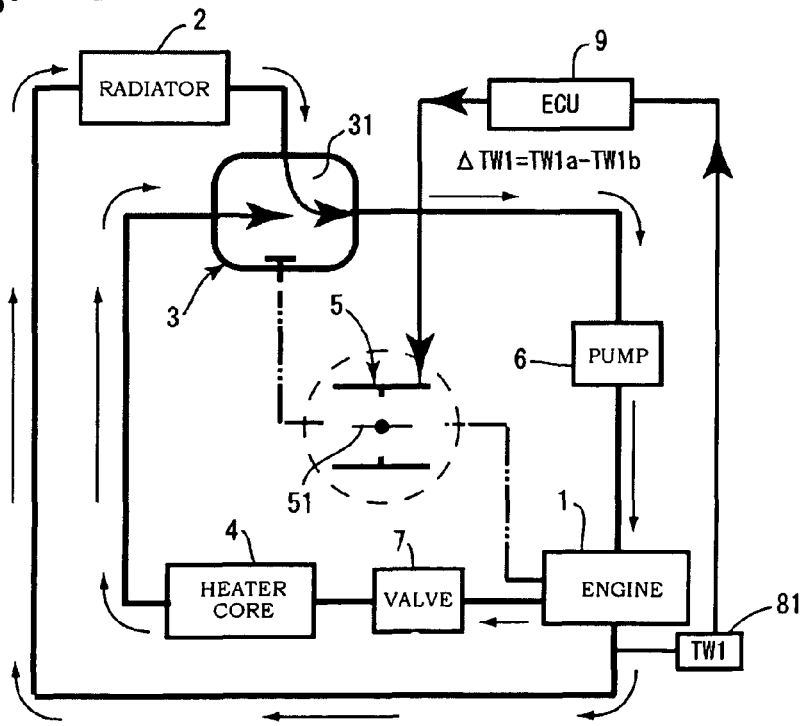
FIG. 4B is a structural diagram illustrating a flow of cooling water in the radiator circulation flow channel and heater circulation flow channel after the end of the warm-up period.

As the temperature of the cooling water in the portion downstream of the engine 1 rises, the value of the temperature difference TW1 decreases (that is, the measured water temperature TW1*b* and the set water temperature TW1*a* become close to each other), the opening and closing valve 51 of the electronically controlled valve 5 opens significantly, and the flow speed in the entire bypass circulation flow channel C increases (see FIGS. 3C and 3D). When the temperature difference TW1 decreases and becomes zero (that is, the measured water temperature TW1*b* becomes equal to the set water temperature TW1*a*), the opening degree ΔTW1 of the opening and closing valve 51 of the electronically controlled valve 5 reaches a maximum, the amount of cooling water flowing through the electronically controlled valve 5 increases, and the flow speed of the cooling water flowing in the entire bypass circulation flow channel C reaches a maximum (see FIGS. 3C and 3D). As a result, cooling efficiency in the warm-up process is maximized.

Figure 5A:
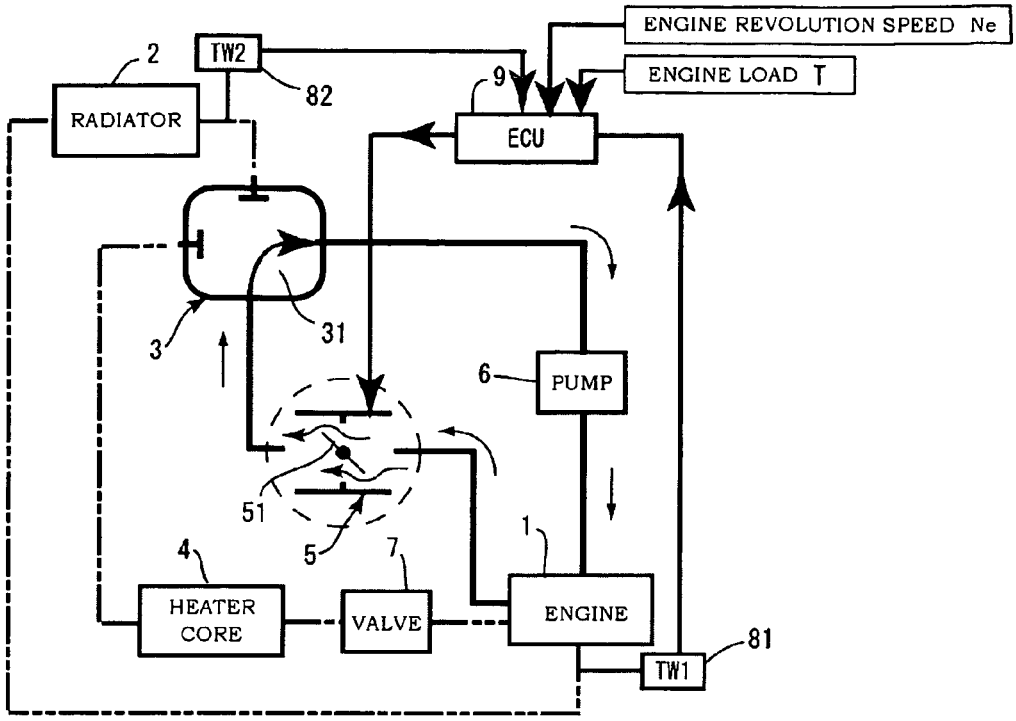
FIG. 5A is a structural diagram illustrating a flow of cooling water at the start of the warm-up period in the bypass circulation flow channel, wherein information on engine revolution speed and engine load is taken into account.
Figure 5B:
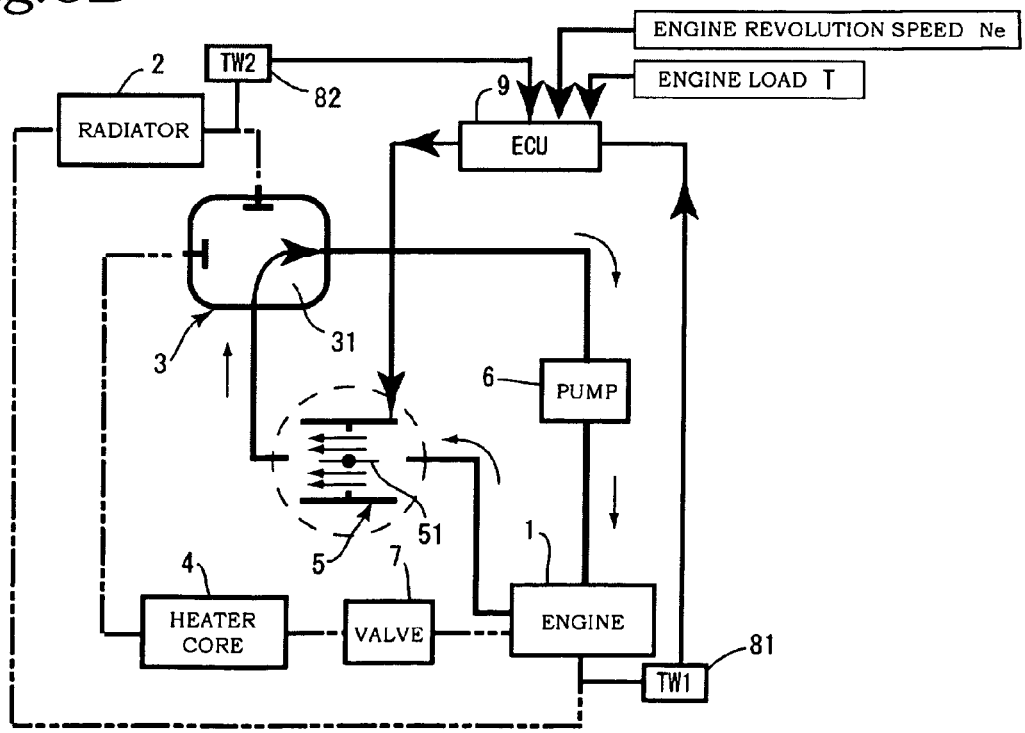
FIG. 5B is a structural diagram illustrating a flow of cooling water at the end of the warm-up period in the bypass circulation flow channel, wherein information on engine revolution speed and engine load is taken into account.

An embodiment is also possible in which the second water temperature sensor 82 is added to the first water temperature sensor 81, the second water temperature sensor 82 corrects the control performed by the first water temperature sensor 81 and the ECU 9, and the opening and closing valve 51 of the electronically controlled valve 5 is controlled with higher accuracy (see FIG. 1 and FIG. 5). The opening of the opening and closing valve 51 of the electronically controlled valve 5 determined by the second water temperature sensor 82 is taken as a correction opening degree ΔTW2. The second water temperature sensor 82 is provided downstream of the radiator 2 and stabilizes the operation of the opening and closing valve 51 of the electronically controlled valve 5 when a large spread is present in a temperature distribution in the radiator circulation flow channel A in the case a water temperature is measured only with the first water temperature sensor 81 provided downstream of the engine 1. The correction opening degree ΔTW2 is obtained by correcting the opening degree of the opening and closing valve 51 of the electronically controlled valve 5 determined by the opening degree ΔTW1 to a more accurate state with consideration for a large spread caused by temperature distribution.

A measured water temperature TW2*b* downstream of the radiator 2 is measured by the second water temperature sensor 82, and an information signal representing the temperature difference with a warm-up end set water temperature TW2*a* is sent to the ECU 9 and controlled. The temperature difference TW2 is determined by the following equation:

Temperature difference *TW*2=Warm-up end set water temperature (*TW*2*a*)−Measured water temperature in the portion downstream of the engine (*TW*2*b*).

The correction opening degree ΔTW2 is determined by the temperature difference TW2, information from the second water temperature sensor 82 is transmitted together with the information from the first water temperature sensor 81 to the ECU 9, and the opening degree ΔTW1 of the opening and closing valve 51 of the electronically controlled valve 5 is corrected by the correction opening degree ΔTW2.

An embodiment of a detection unit is also possible in which the above-described configuration additionally has a feature of setting the opening degree of the electronically controlled valve 5 by an engine revolution speed Ne and an engine load T. More specifically, this embodiment can be represented by the following equation.

(Valve opening degree of electronically controlled valve)=Opening degree Δ*TW*1+(Correction by engine revolution speed *Ne* and engine load *T*)+correction opening degree Δ*TW*2.

Figure 6:
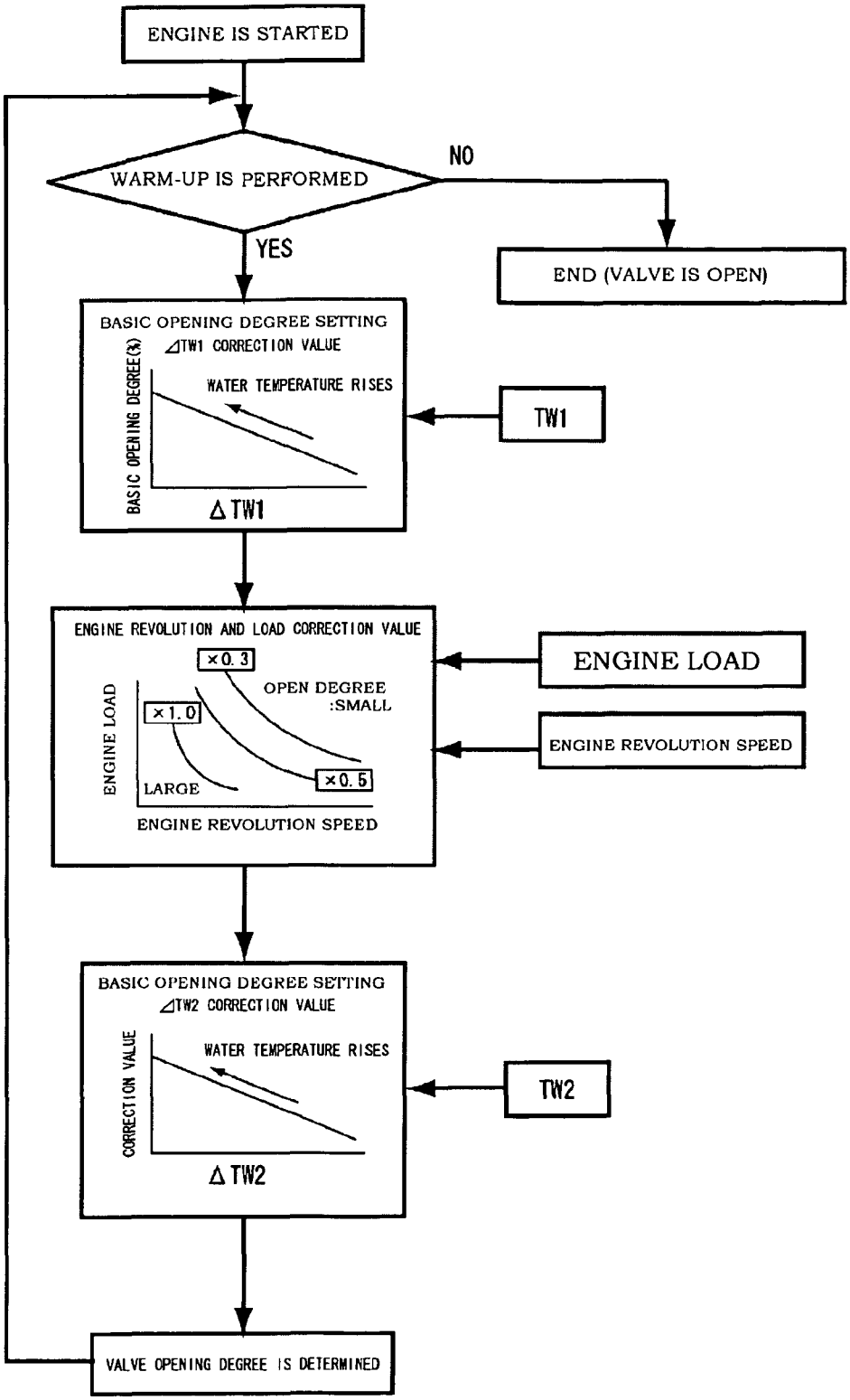
FIG. 6 is a flowchart illustrating the operation of the present invention.

Thus, as the engine revolution speed Ne and engine load T increase, the opening degree of the opening and closing valve 51 tends to decrease and the opening and closing valve 51 of the electronically controlled valve 5 tends to close. Where the directional control valve 31 of the thermostat 3 opens the radiator circulation flow channel A so that the cooling water can freely flow therethrough at the end of the warm-up period, the cooling water is cooled by the radiator 2, and the role of the electronically controlled valve 5 is completed. FIG. 6 is a flowchart illustrating how information based on the temperature difference of cooling water determined by the first water temperature sensor 81 and the second water temperature sensor 82 and information on the engine revolution speed Ne and engine load T are provided in the process from the start to the end of the warm-up period.

With respect to the basic opening degree (ΔTW1) determined by the first water temperature sensor 81, the flowchart indicates that when the measured water temperature TW1 rises, the opening degree ΔTW1 decreases, and the opening of the opening and closing valve 51 increases. As for the correction values for engine revolution speed and load, three lines are drawn and a numerical value used for multiplication decreases in the direction up and to the right. The opening degree of the opening and closing valve 51 decreases accordingly. Because a numerical value used for multiplication increases in the direction down and to the left, the opening degree of the opening and closing valve 51 increases. For example, the corresponding numerical values for multiplication for the lines are (×1.0), (×0.5), and (×0.3) in the direction from the left to the right.

When the numerical value of the correction opening degree ΔTW2 is large, the measured water temperature TW2*b* is low, and a state is assumed in which the entire cooling water circuit has not yet been warmed. Because a small correction value is multiplied in the graph, the opening degree of the opening and closing valve 51 decreases. The increase in measured water temperature TW2*b* means that the entire cooling water circuit has been warmed, and the correction value (opening degree) increases.

As the temperature of cooling water rises, the opening and closing valve 51 of the electronically controlled valve 5 opens gradually, rather than instantaneously. At the end of the warm-up period, the opening and closing valve 51 of the electronically controlled valve 5 assumes a completely open state (fully open), and in the normal operation after the end of the warm-up period, the electronically controlled valve 5 is not specially controlled and remains in an open state. However, because the thermostat 3 serves as a closed valve with respect to the bypass circulation flow channel C during normal operation after the end of the warm-up period, practically no cooling water flows in the bypass circulation flow channel C.

When the engine revolution speed Ne or engine load T rises in the warm-up process, the opening degree of the opening and closing valve 51 of the electronically controlled valve 5 decreases. As a result, the flow rate of cooling water flowing in the heater core 4 disposed in the heater circulation flow channel B, which is disposed in parallel with the bypass circulation flow channel C, somewhat increases, but because the resistance offered by the heater core 4 to the passing water is high and the piping diameter of the heater circulation flow channel B is small, the flow rate of cooling water flowing in the heater circulation flow channel B reaches saturation at (converges to) a certain flow rate and the flow rate in the heater circulation flow channel B does not increase that much.

Furthermore, because a total resistance offered to the passing water of the heater circulation flow channel B and the bypass circulation flow channel C increases when the electronically controlled valve 5 is throttled in the bypass circulation flow channel C, the flow speed of cooling water passing through the engine 1 decreases and the cooling water can pick up more heat from the engine 1, which is a heat generation source. Therefore, even though the engine revolution speed Ne or engine load T has increased, the cooling water can be rapidly warmed up.

Even when the electronically controlled valve 5 is closed, it is not closed completely. Moreover, it is not open abruptly. Thus, because a structure is employed such that the opening and closing valve 51 is opened so that the opening degree increases gradually from the start of the warm-up period, a state is assumed in which the opening and closing valve 51 is open to a certain degree from the initial stage of the warm-up period, a pressure generated by the pump 6 can be released to the zone downstream of the electronically controlled valve 5 and the increase in pressure inside the piping of the radiator circulation flow channel A, heater circulation flow channel B, and bypass circulation flow channel C is inhibited, thereby making it possible to extend the piping service life. Other effects that are demonstrated include the reduction of pulsations generated by the opening and closing valve 51 of the electronically controlled valve 5, which makes it possible to eliminate noise or vibrations causing discomfort to the driver, and also the reduction of pressure inside the piping of the cooling water circuit, which makes it possible to extend the piping service life.

The operation process of the present invention will be described below. When the cooling water is in the coldest state immediately after the engine 1 is started, the opening and closing valve 51 of the electronically controlled valve 5 is substantially closed. Therefore, practically no cooling water flows in the bypass circulation flow channel C. Furthermore, because the thermostat 3 is also substantially closed, only a small amount of cooling water flows in the radiator circulation flow channel A. The cooling water can flow mainly only in the heater circulation flow channel B. The heater valve 7 is disposed upstream of the heater core 4, and when warming inside the vehicle is actuated (ON), the heater valve 7 is open, the cooling water circulates in the heater circulation flow channel B, and the cooling water flows to the heater core 4.

When warming is stopped (OFF), the heater valve 7 is closed, the heater circulation flow channel B is shut down, and no cooling water flows to the heater core 4. As a result, only a very small amount of cooling water flows in the radiator circulation flow channel A and bypass circulation flow channel C. Furthermore, when the cooling water is in the coldest state immediately after the engine 1 is started, the opening degree of the opening and closing valve 51 of the electronically controlled valve 5 is the smallest. Therefore, the cooling water flowing in the bypass circulation flow channel C has the lowest flow speed, the flow speed of cooling water passing through the engine 1, which is a heat generation source, decreases, the interval in which the cooling water passes through the engine 1 extends, and the temperature of cooling water can be rapidly raise.

At this stage, because the opening and closing valve 51 of the electronically controlled valve 5 is in a substantially closed state, if the driver actuates (ON) warming and the heater valve 7 opens, since the resistance offered by the bypass circulation flow channel C to the flowing water increases in the location of the electronically controlled valve 5, a sufficient amount of cooling water is supplied to the heater core 4. Because part of the cooling water flows into the piping of the bypass circulation flow channel C even at the start of the warm-up period and during the warming operation (ON), the cooling water temperature rises rapidly.

In the process from the intermediate stage to the final stage of the warm-up period of the engine 1, the engine 1 is warmed up to a certain degree, and the water temperature measured by the first water temperature sensor 81 mounted downstream of the engine 1 starts rising. At this time, the thermostat 3 is substantially closed. Therefore, the water temperature increase rate measured by the second water temperature sensor 82 mounted downstream of the radiator 2 becomes lower than the water temperature increase rate downstream of the engine 1.

In the above-described control configuration, the opening and closing valve 51 of the electronically controlled valve 5 starts opening, while the opening degree ΔTW1 is being corrected by the correction opening degree ΔTW2. At this point of time, the thermostat 3 is substantially closed. Therefore, only little cooling water flows in the radiator circulation flow channel A. Furthermore, as described hereinabove, because the electronically controlled valve 5 starts opening, a substantial amount of cooling water starts flowing in the bypass circulation flow channel C. Therefore, even when the heater valve 7 is open (warming is actuated), the cooling water flows at a certain ratio into the bypass circulation flow channel C. As a result, the ratio of cooling water flowing to the heater core 4, which is a heat dissipation source, decreases and the cooling water temperature can be raised more rapidly.

In the heater circulation flow channel B, the heater core 4 offers resistance to the passing water, and when the electronically controlled valve 5 is open, because no specific component that offers resistance to the passing water is present in the bypass circulation flow channel C, most of the cooling water tends to flow through the bypass circulation flow channel C, and because most of the cooling water flows through the bypass circulation flow channel C in which no specific heat dissipation source is present, the rise of cooling water temperature is accelerated. Furthermore, when the warming is stopped (OFF), because the heater valve 7 is closed, almost the entire cooling water flows through the bypass circulation flow channel C, the cooling water does pass through a specific heat dissipation source such as the radiator 2 or heat core 4, and the cooling water temperature rises more rapidly.

Because the opening and closing valve 51 of the electronically controlled valve 5 is not completely open, the flow speed of cooling water passing through the engine 1, which is a heat generation source, is lower than that in a state in which the electronically controlled valve 5 is completely open, and the cooling water temperature rises faster than in the case in which no electronically controlled valve 5 is present. Thus, by opening the electronically controlled valve 5 to a certain degree, the flow rate of cooling water flowing through the heater core 4 is decreased and heat dissipation from the heater core 4 is inhibited, and because the electronically controlled valve 5 is not completely open, the control is performed by which a low flow speed of cooling water passing through the engine 1, which is a heat generation source, is maintained.

After the end of the warm-up period, the thermostat 3 opens the directional control valve 31 so that the cooling water flows in a warmed state through the radiator circulation flow channel A, the directional control valve 31 that controls the flow through the bypass circulation flow channel C where the electronically controlled valve 5 is disposed is closed, and the electronically controlled valve 5 is in a closed state, but because the directional control valve 31 of the bypass circulation flow channel C is closed, practically no water flows through the bypass circulation flow channel C. Because the thermostat 3 that controls the flow through the bypass circulation flow channel C is closed, almost the entire cooling water flows through the radiator circulation flow channel A and the cooling water is cooled.

In a region in which the engine revolution speed Ne or engine load T has increased in the warm-up process, the throttle control of the electronically controlled valve 5 is performed. The control is performed for the following reason. In a region with a high revolution speed etc. of the engine 1 or pump 6 in the warm-up process, the flow rate of cooling water inevitably increases because e.g. of increase in the pump revolution speed. Therefore, by throttling the opening and closing valve 51 of the electronically controlled valve 5, the flow rate of cooling water flowing through the heater circulation flow channel B and the bypass circulation flow channel C is reduced and the flow speed of cooling water flowing through the engine 1, which is a heat generation source, is decreased, thereby enabling faster increase in cooling water temperature.

What is claimed is:

1. A cooling device for an engine, comprising:

a radiator flow channel for circulation, in order, from an engine via a radiator to a directional control valve of a thermostat;

a heater flow channel for circulation, in order, from the engine via a heater core to the directional control valve of the thermostat;

a bypass flow channel for circulation, in order, from the engine through an electronically controlled valve to the directional control valve of the thermostat are arranged in series; and a pump that causes a cooling water to circulate, wherein the radiator flow channel, the heater flow channel, and the bypass flow channel merge in the directional control valve of the thermostat and form a common flow channel between the directional control valve of the thermostat and the engine, wherein the pump is provided in the common flow channel, wherein, at the start of the warm-up period and during the warm-up operation, the circulation in the radiator flow channel is substantially stopped by the directional control valve of the thermostat, wherein cooling water circulation is actuated in the bypass flow channel, and an opening degree of the electronically controlled valve is gradually increased from a minimum as the cooling water temperature rises, wherein, at the end of the warm-up period, circulation is actuated in the radiator flow channel, and because the directional control valve of the thermostat is closed although an opening-closing valve of the electronically controlled valve is completely open, a state is established in which the circulation is substantially stopped in the bypass flow channel, wherein the electronically controlled valve is not completely closed even when operated to closed, and the electronically controlled valve is open to a certain degree from an initial stage of the warm-up period, thereby causing a part of the cooling water to flow in the bypass flow channel.

2. The cooling device for an engine according to claim 1, wherein a water temperature measurement and control unit comprising a sensor and an electronic control unit (ECU) is provided in a location downstream of the engine in the radiator channel, and a valve opening degree of the electronically controlled valve increases gradually from a substantially closed state as a difference between a measured water temperature determined by the water temperature measurement and control unit and a set water temperature at the end of the warm-up period decreases.

3. The cooling device for an engine according to claim 1, wherein a detection unit that detects a revolution speed of the engine and an engine load is provided, and a valve opening degree of the electronically controlled valve gradually decreases as the engine revolution speed and load increase.

4. The cooling device for an engine according to claim 1, wherein a heater valve is provided upstream of the heater core of the heater flow channel, and circulation in the heater flow channel can be appropriately stopped.

5. The cooling device for an engine according to claim 1, wherein said directional control valve controlling circulation from the radiator flow channel, the heater flow channel, and the bypass flow channel distribution to the common flow channel.

6. The cooling device for an engine according to claim 5, wherein, during a rapid heating operation of the warm-up period, the circulation in the radiator flow channel is substantially interrupted by the directional control valve and a state is assumed in which the cooling water practically does not pass into the radiator.

7. The cooling device for an engine according to claim 6, wherein, during the rapid heating operation of the warm-up period, the electronically controlled valve inhibits the cooling water circulation through the bypass circulation flow channel to a slow state.

8. The cooling device for an engine according to claim 7, wherein, as a temperature of the cooling water circulation rises, the electronically controlled valve opens significantly, and the flow speed in the bypass circulation flow channel increases.

* * * * *